US008303375B2

(12) United States Patent
Oliver

(10) Patent No.: US 8,303,375 B2
(45) Date of Patent: Nov. 6, 2012

(54) POLISHING PADS FOR CHEMICAL MECHANICAL PLANARIZATION AND/OR OTHER POLISHING METHODS

(75) Inventor: Michael R. Oliver, Portland, OR (US)

(73) Assignee: Novaplanar Technology, Inc., Portland, OR (US)

( * ) Notice: Subject to any disclaimer, the term of this patent is extended or adjusted under 35 U.S.C. 154(b) by 0 days.

(21) Appl. No.: 13/280,261

(22) Filed: Oct. 24, 2011

(65) Prior Publication Data

US 2012/0058712 A1 Mar. 8, 2012

Related U.S. Application Data

(63) Continuation-in-part of application No. 12/685,467, filed on Jan. 11, 2010, now abandoned.

(60) Provisional application No. 61/144,004, filed on Jan. 12, 2009.

(51) Int. Cl.
*B24B 1/00* (2006.01)

(52) U.S. Cl. ..... 451/41; 451/59; 451/526

(58) Field of Classification Search ..... 451/41, 451/59, 63, 526, 527, 530, 533
See application file for complete search history.

(56) References Cited

U.S. PATENT DOCUMENTS

| | | | | |
|---|---|---|---|---|
| 5,944,583 | A | 8/1999 | Cruz | |
| 6,332,832 | B1 | 12/2001 | Suzuki | |
| 6,354,915 | B1 | 3/2002 | James et al. | |
| 6,362,107 | B1 | 3/2002 | Shiro | |
| 6,435,942 | B1 | 8/2002 | Jin | |
| 6,454,634 | B1 * | 9/2002 | James et al. | 451/41 |
| 6,461,226 | B1 | 10/2002 | Yi | |
| 6,477,926 | B1 | 11/2002 | Swisher | |
| 6,500,053 | B2 | 12/2002 | James et al. | |
| 6,561,890 | B2 | 5/2003 | Tominaga | |
| 6,582,283 | B2 * | 6/2003 | James et al. | 451/41 |
| 6,626,740 | B2 | 9/2003 | Baker et al. | |
| 6,648,733 | B2 | 11/2003 | Roberts et al. | |
| 6,705,934 | B1 | 3/2004 | Shiro | |
| 6,749,485 | B1 * | 6/2004 | James et al. | 451/41 |
| 6,837,706 | B2 | 1/2005 | Straetmans | |
| 6,837,781 | B2 | 1/2005 | Hishiki | |
| 6,860,802 | B1 | 3/2005 | Vishwanathan et al. | |
| 6,899,602 | B2 | 5/2005 | Fawcett et al. | |
| 6,932,677 | B2 | 8/2005 | Nakano | |
| 6,935,931 | B2 | 8/2005 | Prasad | |
| 6,986,705 | B2 | 1/2006 | Preston | |
| 7,037,184 | B2 | 5/2006 | Petroski | |
| 7,074,115 | B2 | 7/2006 | James et al. | |
| 7,097,549 | B2 | 8/2006 | Allison | |
| 7,098,255 | B2 | 8/2006 | Seyanagi | |
| 7,169,030 | B1 | 1/2007 | Kulp et al. | |
| 7,217,179 | B2 | 5/2007 | Sakurai | |

(Continued)

FOREIGN PATENT DOCUMENTS

EP 1470892 A1 10/2004

(Continued)

*Primary Examiner* — Eileen P. Morgan
(74) *Attorney, Agent, or Firm* — Schwabe, Williamson & Wyatt

(57) ABSTRACT

Embodiments herein provide polishing pads that produce high post-polish planarity, such as on a wafer substrate or other substrates. Exemplary pads include a bulk matrix and embedded polymer particles. Pads according to embodiments herein may be used to remove material over a composite substrate, comprised of two or more different materials, or a substrate comprised of a single material.

15 Claims, 3 Drawing Sheets

U.S. PATENT DOCUMENTS

| | | | | |
|---|---|---|---|---|
| 7,220,167 | B2 | 5/2007 | Feng | |
| 7,261,625 | B2 | 8/2007 | Hishiki | |
| 7,329,140 | B2 | 2/2008 | O'Connell | |
| 7,329,174 | B2 | 2/2008 | Hosaka | |
| 7,354,527 | B2 | 4/2008 | Tano | |
| 7,371,160 | B1 | 5/2008 | Cruz et al. | |
| 7,704,125 | B2 * | 4/2010 | Roy et al. | 451/41 |
| 2005/0020082 | A1 * | 1/2005 | Vishwanathan et al. | 438/690 |
| 2005/0079806 | A1 * | 4/2005 | James et al. | 451/41 |
| 2005/0197050 | A1 * | 9/2005 | Prasad et al. | 451/41 |
| 2006/0035573 | A1 | 2/2006 | Preston | |
| 2006/0046622 | A1 * | 3/2006 | Prasad | 451/41 |
| 2006/0280929 | A1 | 12/2006 | Shimomura et al. | |
| 2007/0066195 | A1 | 3/2007 | Duong | |
| 2008/0057845 | A1 * | 3/2008 | Prasad | 451/530 |
| 2009/0053976 | A1 * | 2/2009 | Roy et al. | 451/36 |
| 2009/0298392 | A1 * | 12/2009 | Okamoto et al. | 451/41 |
| 2010/0029185 | A1 * | 2/2010 | Fukuda et al. | 451/527 |

FOREIGN PATENT DOCUMENTS

| | | | |
|---|---|---|---|
| JP | 2005-131732 | A | 5/2005 |
| JP | 2005136400 | A * | 5/2005 |

* cited by examiner

POLISHING PADS FOR CHEMICAL MECHANICAL PLANARIZATION AND/OR OTHER POLISHING METHODS

CROSS REFERENCE TO RELATED APPLICATIONS

The present application is a continuation-in-part of and claims priority to U.S. patent application Ser. No. 12/685,467, filed Jan. 11, 2010, which claims priority to U.S. Provisional Patent Application No. 61/144,004, filed Jan. 12, 2009, the entire disclosures of which are hereby incorporated by reference in their entirety.

TECHNICAL FIELD

Embodiments herein relate to polishing pads for chemical mechanical planarization and/or for other polishing methods, including polishing various surfaces/substrates.

BACKGROUND

Chemical Mechanical Planarization (CMP) is a method for planarizing the surface of substrates in semiconductor processing. CMP material removal occurs typically by simultaneous chemical and mechanical interaction with the substrate. With CMP, a highly planar surface may be obtained, which is very useful for many semiconductor device structures.

One structure used in CMP is a polishing pad. Pads may comprise a variety of materials and are used, sometimes in conjunction with a polishing fluid (slurry) as the CMP interface with the surface of a substrate. In general, polishing pads may be used for CMP or for other polishing methods, including polishing the surfaces of a variety of substrates.

BRIEF DESCRIPTION OF THE DRAWINGS

Embodiments herein will be readily understood by the following detailed description in conjunction with the accompanying drawings. To facilitate this description, like reference numerals designate like structural elements. Embodiments herein are illustrated by way of example and not by way of limitation in the figures of the accompanying drawings.

DETAILED DESCRIPTION OF DISCLOSED EMBODIMENTS

Figure 1:
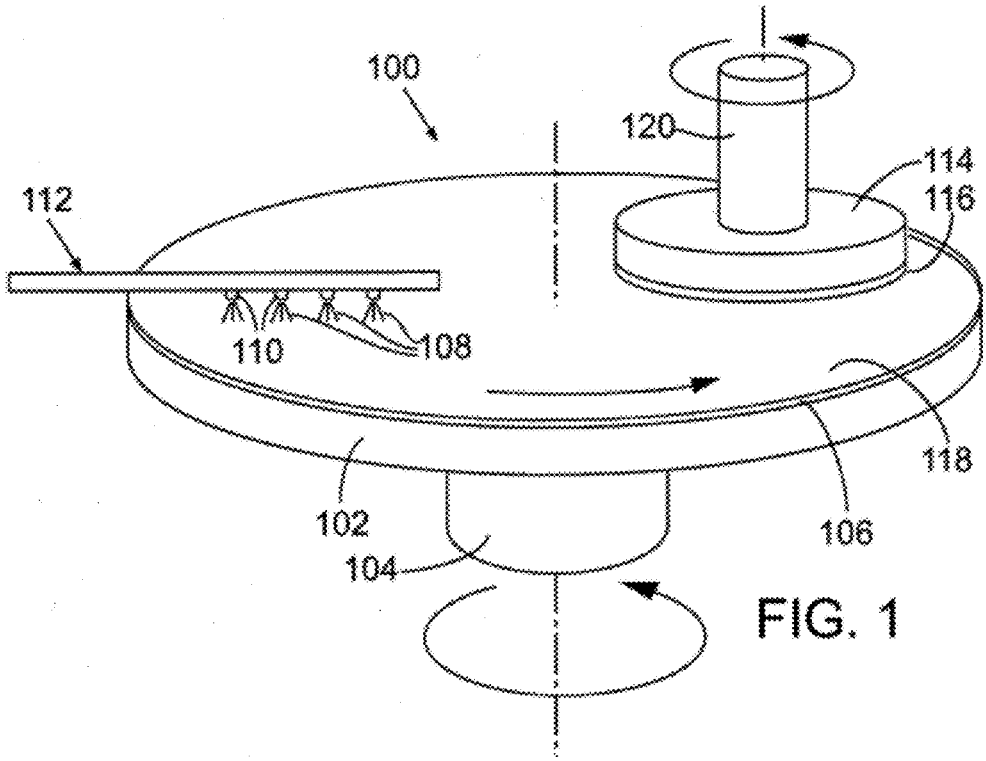
FIG. 1 illustrates a perspective view of a substrate processing apparatus in accordance with a representative embodiment.

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the intended scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments herein.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments herein, are synonymous.

Embodiments herein provide polishing pads that produce high post-polish planarity on a substrate. Pads according to embodiments herein may be used to remove material over a composite substrate, comprised of two or more different materials, or a substrate comprised of a single material. While CMP is mentioned herein as a suitable method for use of the described pads, use with other polishing methods, including use on other substrates, is also contemplated and within the scope of the embodiments.

In embodiments, polishing pads described herein may be used to polish semiconductor materials, wafers, silicon, glass, metal, microelectromechanical systems (MEMS), sapphire, etc.

In an exemplary embodiment referred to as copper CMP, the copper and barrier layer on top of the dielectric may be removed, and polishing may be terminated when the dielectric between the copper conductors is completely exposed. It may also be terminated when all of the copper is removed and only the thin barrier layer remains.

In embodiments, a polishing pad may be fabricated from silicone rubber, also referred to as siloxane polymer. In an embodiment, a pad may have a bulk matrix, such as constructed, at least in part, from a siloxane polymer, and may, in an embodiment, contain embedded particles of a different material, such as polyurethane.

In an embodiment, a pad constructed from a siloxane polymer material is moderately compressible, having a storage modulus, E', such as within a factor of ten of $1\times10^6$ Pascals (Pa). In embodiments, the storage modulus, E', and the loss modulus, E", may be varied over a moderate range for siloxane polymers. A representative value for E' is about $1\times10^6$ Pa for siloxane polymers, but may range from about $1\times10^5$ Pa to $1\times10^7$ Pa, with a suitable sub-range falling between about $2\times10^5$ Pa and about $5\times10^6$ Pa and more particularly between above $4\times10^5$ Pa and about $2\times10^6$ Pa. In an embodiment, with decreasing density, the storage modulus E' decreases. In an embodiment, a corresponding suitable value for E" is about $1\times10^4$ Pa to about $1\times10^6$ Pa, such as about $1\times10^5$ Pa. In embodiments, the above-described values may be suitable for pads constructed from other bulk matrix materials.

In an embodiment, a polishing pad is provided comprising a matrix comprising a material having a storage modulus of about $1\times10^5$ Pa to about $1\times10^7$ Pa and a loss modulus of about $1\times10^4$ Pa to about $1\times10^6$ Pa; and polymer particles embedded within the matrix and having a mean particle diameter of approximately 10 to 100 μm.

The mechanical properties of the bulk siloxane polymer matrix primarily determine the mechanical response of the pad. These properties may be controlled, for example, by changing the composition and/or density of the bulk polymer and/or the embedded particles. In embodiments, both E' and E" may be varied significantly by changing the chemistry of the starting materials when making a siloxane polymer. These properties may also be modified by the addition of particles, such as small fumed silica particles. Such particles may be added to increase E'.

When compressed, pads in accordance with embodiments rebound slowly enough to produce a low defect surface with low dishing, and thus highly planar polished surfaces on composite structures. A pad in accordance with embodiments herein may be dissipative, having a loss factor, tan δ, of about 0.1. The loss factor, tan δ, is the ratio of the loss modulus, E", to the storage modulus, E'.

In embodiments, tan δ may be at least about 0.05 and, in other embodiments, may be greater than about 0.1. In embodiments, tan δ may be about 0.05 to about 0.4, preferably between 0.05 and 0.3, such as between 0.05 and 0.1.

In an embodiment, a polishing pad is provided comprising a matrix comprising a siloxane polymer having a loss factor of between 0.05 and 0.3, such as between 0.05 and 0.1; and a plurality of polymer particles embedded within the matrix, the polymer particles having a different chemical composition from that of the matrix.

In an embodiment herein, the polymer particles are intended to remain embedded in the bulk matrix of the pad, and are not intended to be easily released from the pad into the polishing slurry.

In an embodiment, a siloxane polymer may create a mechanical response at the pad surface, especially the local slow rebound of the pad surface which may produce a high planarity of the finished substrate. In an embodiment using a siloxane polymer, the loss factor increases with increasing frequency (decreasing time). This loss response produces a mechanical response of a pad in which the pad is not capable of quickly providing an upward force beyond the plane of the surface being polished thus beneficially inhibiting the creation of topography in the material being polished. For typical CMP operating conditions, these properties result in a very planar final surface with low defect level, even when the substrate is a composite of multiple types of materials.

Pads in accordance with embodiments herein may be utilized to polish surfaces of one material, such as silicon or glass, as well as for surfaces of two or more materials such as encountered in CMP of semiconductors. The beneficial polishing characteristics are enabled by (1) the low E' of the bulk matrix that results in a small additional increase in local force per unit area when the pad is compressed, and (2) the properties of the pad that do not allow the polymer particles within it to be pushed well above the polishing plane. The mechanical properties of the pad restrict the pad from driving itself into the material being polished, and restrict it from pushing slurry particles well beyond the polishing plane. The combination of these properties reduces the capability of the pad to provide a strong, localized pressure beyond the polishing plane, which is a key mechanism for defect generation in a surface being polished.

While siloxane polymers may be formed from polydimethylsiloxane (PDMS)-based precursors, the length of the starting chains may be modified as desired. In an embodiment, some fraction of the methyl side groups on the siloxane chain may be substituted with other moieties. Such substitution may affect the amount of crosslinking between siloxane chains. Other factors, such as the catalyst used and the curing process, may also affect the chemical interaction of crosslinking. For most polishing processes, a high degree of crosslinking is desirable. Thus, in accordance with the teachings herein, a siloxane material chemistry may be formulated to optimize E' and E" for a given application.

In addition to the chemical processes discussed above, in embodiments, siloxane polymers may also be produced as a sponge or a foam, for example, with pockets of gas contained within the polymer matrix. In an embodiment, a suitable gas may be air, nitrogen, or another suitable gas. For example, with a sufficient addition of foaming chemistry to the starting materials, enough gas may be created. This may result in the gas pockets being interconnected, producing what is known as open-celled foam. Thus, the capability to add varying amounts of foaming agents to the starting materials allows for the formulation of a wide range of foam densities. In an embodiment, a foam may be created by reactions occurring during a curing process at a suitable curing temperature.

There is a wide range of final structures of siloxane polymers that may be fabricated in accordance with embodiments described herein. Further details of such polymers may be found in *Siloxane Polymers*, by Clarson and Semlyen (1993), the contents of which are hereby incorporated by reference.

In an embodiment, a pad may have a bulk matrix, such as constructed, at least in part, from a siloxane polymer. The bulk matrix of a pad in accordance with an embodiment may be siloxane polymer, including, for example, polydimethylsiloxane and chemical variants thereof (such as crosslinked and/or fluorinated polydimethylsiloxane), or combinations of more than one polymer.

In an embodiment, a bulk matrix may also contain particles of a different material, such as polyurethane, embedded within the bulk matrix. In such embodiments, these particles, when they are exposed at the pad surface, may be the primary or sole locus of the interaction of the pad with the substrate to be polished or with the polishing fluid/slurry being utilized. In an embodiment, the particles may abrade more slowly than the bulk material such that the particles serve as the primary source of contact with the substrate.

In an embodiment, a polymer pad defines a pad volume, wherein the polymer particles comprise approximately 10-30%, such as approximately 20-25%, for example 20%, of the volume of the pad. In an embodiment, the particles may be 10-30% of the pad volume distributed throughout the pad which helps ensure there is a sufficient particle surface area (approximately 10-30%) at the pad surface for polishing. In contrast, a standard polishing pad only uses about 1% of the pad surface for polishing since it is the micro-scale asperities that provide the loci of polishing.

Because of the large increase in polishing surface area in pads of the present disclosure compared to the polishing surface area of a standard pad, the local polishing pressures are quite different as well. In a standard pad, a typical polishing pressure would be about 800-1000 psi, whereas in a pad in accordance with an embodiment herein, a typical polishing pressure would be about 10-20 psi.

In an embodiment, a preferred particle type is a polymer, such as polyurethane, which is widely used as a bulk material for CMP pads. In an embodiment, it may be used as a surface material where the polishing interaction between the pad and the substrate takes place. In embodiments, other types of particles, such as polyurea, polycarbonate, polyether, polyester, hydroxylated polyester, polysulfone, polystyrene, polyamide, polyacrylamide, polypropylene, polyethylene, polybutadiene, polyvinyl chloride, polymethyl methacrylate, polyvinyl alcohol, or nylon, among others, may be used as well. Suitable particles may be selected for their properties at the pad-particle-wafer and/or the pad-particle-slurry interface. Suitable particles generally have adequate surface energy and may further be used to enhance the polish interface between the pad and the substrate In an embodiment, polymer particles have a mean particle diameter of approximately 10-100 μm, such as 50-70 μm, for example 60 μm.

In embodiments, polymer particles may be randomly distributed in the matrix, or further may be relatively uniformly distributed throughout the matrix.

In an embodiment, there may be a distribution of the sizes of particles within the pad matrix. In an embodiment, the particles may be selected or controlled to be of a desired size or within a desired size range. For example, particles may be filtered to remove particles above and/or below a certain size, such as below 30 μm.

In embodiments, one or more particle types/compositions may be used as desired for embodiments herein. Using different particle types may be advantageous, for example, for polishing more than one type of material in a single substrate or in different substrates. In embodiments, the particle material(s) may be matched to the polishing fluids/slurries to be used and/or to the substrates to be polished to maximize specific polishing effects of the pad. In an embodiment, particles larger than a certain diameter may be used to polish a surface having various features to ensure the particles do not extend too far into such features (for example, a line on a semiconductor) during polishing.

For polishing surfaces of only one material, such as silicon or glass, there are no features on the object being polished that suggest a limit on the size of the polymer particles within the pad. In such an embodiment, any limitations on particle size occur as part of optimization of the polishing process itself, i.e., the polishing rate and the polishing uniformity may be modulated by the size and density of the polymer particles within the pad. This control allows the overall polishing process optimization with respect to parameters including speed, cost and polishing figures of merit such as uniformity.

In accordance with an embodiment, embedded pad particles provide contact points between the pad, the substrate, and slurry particles, or, for particle-free slurries, between the pad and the substrate being polished. By using embedded particles in this manner, in embodiments, certain functions of the pad may be controlled separately. In an embodiment, the polymer particles of the pad, which may be the primary contact points on the surface of the pad, interact with the slurry particles and the substrate being polished. The pad polymer particles may be selected for high CMP material removal rate or other CMP performance criteria such as low defect generation.

In an embodiment, the bulk mechanical response of the pad may be separately adjusted by using one or more different materials with different mechanical properties.

One exemplary desirable material for a CMP polishing pad is a siloxane polymer. Its low storage modulus, E', and high loss factor, tan δ, may produce a highly planar final structure on a polished composite substrate. A secondary material may also be included within the polymer matrix in a density of, for example, approximately 10-30% such as approximately 10%, 15%, 20%, or 30%. In an embodiment, silica filler particles, or other filler particles, may also be included in the bulk matrix to change some bulk mechanical properties such as the storage modulus, E'.

In an embodiment, an important feature of a pad as described herein is the surface energy of the particles during polishing. In certain known pads, particles are provided in the matrix but are released into the slurry during polishing. A pad as described herein provides particles that are embedded in the matrix and thus provide the loci of polishing. During polishing, a pad matrix may have a surface energy of approximately 15-25 mN/m, whereas a polymer particle may have a surface energy of approximately 40-60 mN/m. In other embodiments, such surface energies may be defined as a ratio of particles to matrix of from about 4:1 to about 2:1.

Siloxane polymers formed from PDMS are generally hydrophobic, with surface energies on the order of 20 mN/m. In an embodiment, it is desirable for CMP to use a polishing fluid, or slurry, to wet the interactive pad surface to provide for improved CMP operation. In an embodiment, it is important that the local pad surface where polishing occurs be wetted. For the polymer particles noted above, they have higher surface energy than the siloxane matrix. With polyurethane particles, for example, which have a surface energy in the range of 40-50 mN/m, improved local wetting occurs where the polishing action takes place. Other polymer particle types, such as polycarbonate, polyester, etc., also provide locally higher surface energy at the site of the polishing process.

In an embodiment, the siloxane polymer itself may be made more hydrophilic by chemical modifications to the PDMS starting material. Substitution of one or more of the methyl groups in the PDMS backbone by polyether or other groups may produce a higher surface energy, and hence may make the polymer more hydrophilic.

There are thus multiple approaches that may be used in embodiments to improve the wettability of the surface of a siloxane polymer-based pad. These include: 1) modification of the siloxane matrix material by chemical addition/substitution, 2) incorporation of higher surface energy particles into the pad material, resulting in a heterogeneous structure, and 3) roughening the surface of the pad.

In embodiments, methods of manufacturing siloxane polymer objects include, but are not limited to calendering, compression molding, spraying, dispersion, and extrusion.

One method that lends itself well to manufacture of polishing pads for CMP is compression molding. In a compression molding process, the uncured silicone rubber precursors, as well as polishing particles, such as polyurethane, may be placed in the mold, which may then be covered and heated. In an embodiment, the top surface of the mold may have a pad groove design in it. After the pad is formed, it may be cured in a separate oven.

Another method in accordance with an embodiment that lends itself well to the manufacture of polishing pads for CMP is calendering. In such an approach, the silicone polymer feed stock is passed through sets of three or four rollers, and the material is squeezed out into sheets of well-controlled thickness. For example, sheets over one meter width may be made with this approach. After exiting the last set of rollers, the polymer sheet may be placed in a curing oven, where it may be given a controlled thermal cure. The time and temperature of the cure cycle may be determined by the incoming siloxane polymer chemistry and the curing agent incorporated into the initial chemistry mix. The separation between the final two rollers determines the thickness of the sheet. Sheets may be cured, for example, after groove patternings, or may be used as preforms for a molding process.

In an embodiment, a preferred thickness range for CMP pads is in the range of 10-200 mils. Such a thickness range may be achieved, for example, by calendering or molding.

In an embodiment, a siloxane polymer is quite flexible in this thickness range (10-200 mils). In an embodiment, one method to improve the plane stiffness may be to put the siloxane polymer on a relatively stiff supporting material, such as when it goes through the final pair of rollers in a calendering method. One useful material for such an embodiment is polyester cloth, about 0.020" thick, which has been cleaned and heatset. The structure resulting from a calendering process as described above may incorporate the permeable cloth as the bottom layer of a two-, or multi-, layer structure. In embodiments, suitable materials, such as polyester, glass, nylon, rayon or cotton, may be used to provide in-plane stiffness, permeability, and/or thermal and chemical robustness.

In a suitable calendering system, multiple layer structures in accordance with embodiments may be created. For example, in an embodiment, a structure may initially be created with a cloth layer to provide high in-plane stiffness and an ungrooved, siloxane polymer layer. In an embodiment, the multi-layer structure may then be partially cured, and subsequently used as the bottom layer between the final rollers when a second siloxane polymer layer is added to the top of the structure. This top layer, which may be the layer in contact with the slurry and wafer, or other surface to be polished, may, in an embodiment, be grooved or ungrooved and may have a composition different from the base layer.

In an embodiment, multiple layers of different materials may be used to control the CMP planarization properties of the pad over long distances across the surface of the wafer, and not just at the interface between two materials on the composite surface of the wafer. In embodiments, planarization lengths of several millimeters may be achieved. Additional details regarding multiple layered pads that may be incorporated with embodiments herein may be found in U.S. Pat. No. 5,212,910, the entire contents of which are hereby incorporated by reference.

In embodiments, CMP pads may have grooves or other patterning in various configurations for improved polishing performance. In embodiments, dimensions of spacing and groove depth may be varied over a wide range. In an embodiment, suitable grooves may be, for example, about 0.010 to about 0.050 inches deep and/or wide. In an embodiment, suitable grooves may be spaced from about 0.020 to about 0.5 inches apart, in a variety of patterns, as desired.

Grooves may be formed in a siloxane polymer pad in several ways, such as by molding. In an embodiment, an uncured polymer may be soft enough to emboss grooves into it by a patterned roller, or by a stamp. In an embodiment, for a compression molded pad, the top interior surface of the mold may have a raised pattern, so that the pad is patterned when it exits the mold. Clearly, the pattern may be whatever may be created with a raised structure on the mold surface, for example square patterns, hexagonal patterns or concentric grooves.

FIG. 1 illustrates a perspective view of a substrate processing apparatus in accordance with an exemplary embodiment.

A system 100 for chemical mechanical polishing may include a rotating platen 102, which is driven through a drive shaft 104. A polishing pad 106 is attached to the top surface of platen 102. Polishing slurry 108 is dispensed on the pad from one or more orifices 110 on the slurry dispensing arm 112. Wafer carrier 114 holds the wafer (with retaining ring) 116. Wafer 116, with the side to be planarized face down, is pressed against the surface 118 of polishing pad 106 and rotated by the carrier drive shaft 120.

Figure 2:
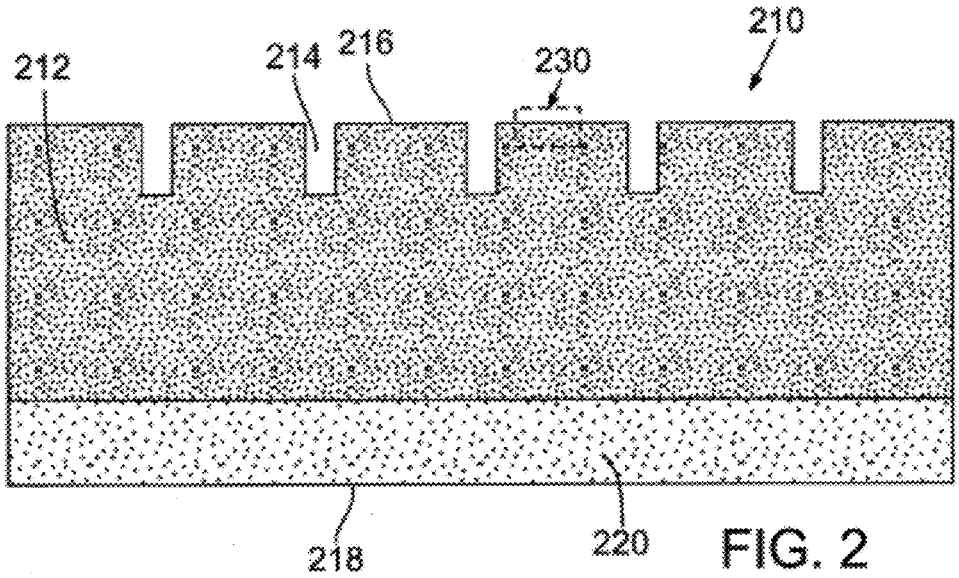
FIG. 2 illustrates a cross-sectional view of a pad in accordance with an embodiment.

Pad 210 is seen in cross section in FIG. 2 and represents an exemplary embodiment. Top surface 216 of pad 210 is the polishing, or planarizing, surface. Body 212 of pad 210 is composed of the matrix material and polymer particles. Pad 210 is built on a supporting cloth layer 220. Grooves 214 are cut into surface 216 of pad 210 for proper slurry flow. Pad 210 may be attached to a platen surface with an adhesive layer 218.

Figure 3:
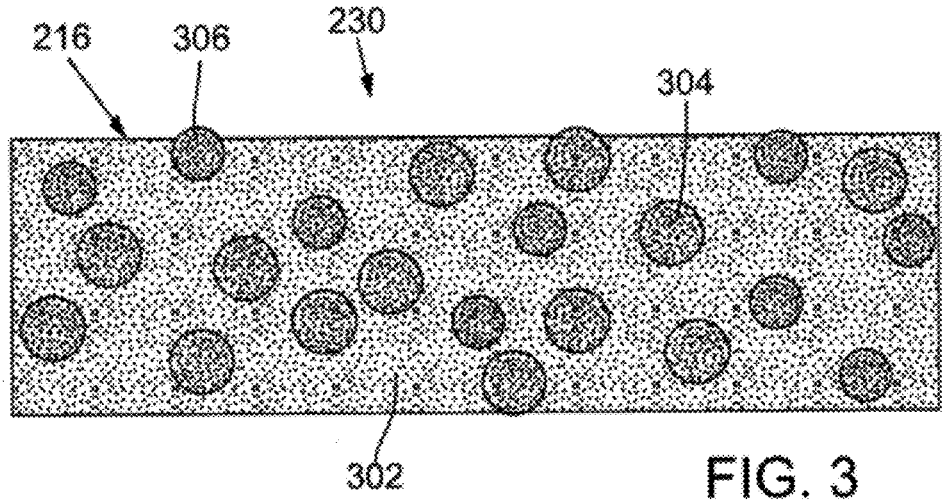
FIG. 3 illustrates an expanded cross-sectional view of a portion of the pad of FIG. 2 in accordance with an embodiment.

An exemplary expanded cross section of location 230 near top surface 216 of pad 210 is shown in FIG. 3. The pad is composed of a siloxane polymertrix 302 and polymer particles 304. Pad surface 216 has some exposed polymer particles 306.

Figure 4:
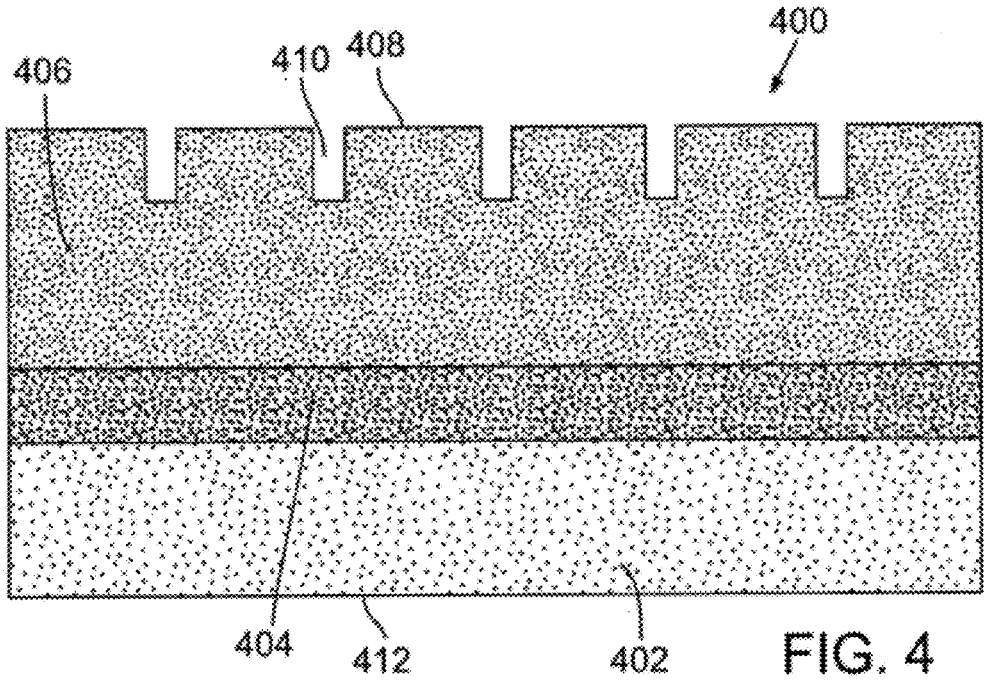
FIG. 4 illustrates a cross-sectional view of a pad in accordance with an embodiment.

FIG. 4 shows a pad structure with two layers of matrix material in accordance with an embodiment. Pad 400 is composed of a supporting layer 404, such as constructed from polyester, glass, nylon, rayon, or cotton, etc. in contact with a lower layer or base pad 402 of material, constructed from foam, or a similarly structured or functioning material. In an embodiment, lower layer 402 is compressible and may help compensate for pad height variations. In an alternative embodiment, lower layer 402 may be absent. Upper layer 406 is the bulk matrix material, such as constructed from a siloxane polymer, in which pad surface 408 is formed. Grooves 410 are formed in the second layer, but in an embodiment may extend further into a lower layer or layers. The entire structure has an adhesive layer 412 to provide contact, for example, to a platen surface. The local polishing rate at any point of the material on the wafer surface increases with increasing down force between the wafer and the pad and with increasing relative velocity between the wafer and the pad. Other parameters such as the pad type and structure, as well as the chemistry and particles of the slurry also determine the material removal rate. For additional details regarding such parameters, see *Chemical-Mechanical Planarization of Semiconductor Materials*, M. R. Oliver (ed.), Springer Verlag, the entire contents of which are hereby incorporated by reference.

Although the pads of FIGS. 2 and 4 are shown with grooves, in embodiments, pads may be constructed without grooves or patterning, or pads may have other surface patterning in addition to or instead of the represented grooves.

Embodiments herein provide polishing with low dishing. Such low dishing may be accomplished by one or both of two mechanisms of action.

The first mechanism of action causing low dishing is based on the mechanical properties of the matrix. The polymer particles embedded in the low E', lossy pad do not rebound quickly to reach down and polish in a recess during polishing. A polymer particle meets the far side of a recessed structure in the horizontal direction before the pad can push it down very far into the recess. As a result, for narrow recesses, the surface of the polishing polymer particle does not reach the bottom of the recess and no further material is removed. This mechanism is particularly effective for recesses of small lateral dimension, for example less than 20 μm, when the direction of polishing is substantially across this short dimension.

When the direction of travel is along a much longer dimension, such as a long conductor line, another mechanism may come into play.

The second mechanism of action causing low dishing is based on the size of the pad polymer particle. In embodiments, the polymer polishing particles have large dimensions relative to the narrow structures they are polishing. For example, a polymer particle may have a diameter of ≧20 μm or so, while at the same time the long line being polished is very narrow. At current technology levels, these are less than 5 μm wide. As a result, the particle, when it is on top of a narrow structure can not reach down very far into a recess in that structure. This limiting mechanism holds for the component of the relative velocity of the particle along the long dimension of the structure being polished. For conducting lines in a semiconductor structure, this direction is along the length of the conductor.

The two limiting mechanisms both contribute to the limitation of dishing, especially in the case of recessed structures where the long and short dimensions are greatly different. Both mechanisms are made possible by the large polymer particles keeping their shape during polishing. This is in contrast to a standard polymer pad, where narrow asperities are compressed under very high pressure during polishing. When these asperities, with their high E', reach a recess, the asperities very quickly reach down into the recess. Results from the literature show this is usually on the order of 1000-2000 Å, for processing with standard pads and processes.

In an embodiment, polymer particles may have a mean diameter at least approximately 2-20 times, such as approximately 2, 4, 6, 8, 10, 15, 20, or more times, larger than the linewidth of the lines being polished by the pad.

Figure 5:
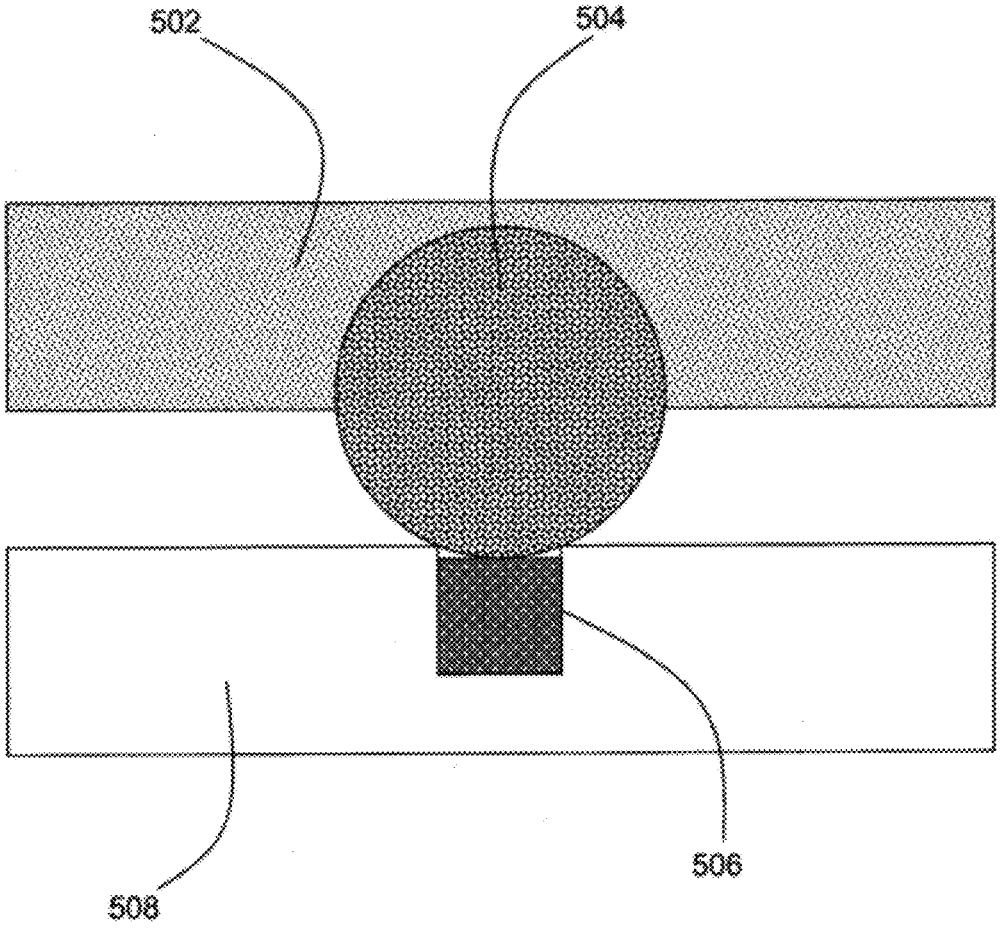
FIG. 5 illustrates an exemplary schematic of a pad and particle interacting with a substrate in accordance with an embodiment.

FIG. 5 illustrates an exemplary schematic of a pad and particle interacting with a substrate. Pad 502 has a polymer particle 504. Polymer particle 504 is contacting a line 506 formed in substrate 508. For example, line 506 may be a metal line and substrate 508 may be a dielectric material. As may be seen, the size of particle 504 relative to the linewidth prevents particle 504 from reaching down into line 506 to remove material beyond a certain depth.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that herein may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A polishing pad, comprising:

a matrix comprising a siloxane polymer having a storage modulus of about $1\times10^5$ Pa to about $1\times10^7$ Pa, a loss modulus of about $1\times10^4$ Pa to about $1\times10^6$ Pa, and a loss factor, tan (δ), wherein tan (δ) is between about 0.05 and about 0.3; and a plurality of polymer particles embedded within the matrix, the polymer particles having a different chemical composition from that of the matrix.

2. The polishing pad of claim 1, wherein tan (δ) is between about 0.05 and about 0.1.

3. The polishing pad of claim 1, wherein the polishing pad defines a pad volume, and the polymer particles comprise approximately 10 to 30% of the pad volume during polishing.

4. The polishing pad of claim 1, wherein the polymer particles comprise at least one of polyurethane, polyurea, polycarbonate, polyether, polyester, polysulfone, polystyrene, polyamide, polyacrylamide, polypropylene, polyethylene, polybutadiene, polyvinyl chloride, polymethyl methacrylate, polyvinyl alcohol, and nylon.

5. The polishing pad of claim 1, wherein the particles provide the loci of polishing.

6. A polishing pad, comprising:

a matrix comprising a material having a storage modulus of about $1\times10^5$ Pa to about $1\times10^7$ Pa and a loss modulus of about $1\times10^4$ Pa to about $1\times10^6$ Pa; and a plurality of polymer particles embedded within the matrix during polishing and having a mean particle diameter of approximately 10 to 100 μm, wherein the matrix has a surface energy of approximately 15-25 mN/m and the particles have a surface energy of approximately 40-60 mN/m and wherein the matrix material comprises a loss factor, tan (δ), between about 0.05 and about 0.3.

7. The polishing pad of claim 6, wherein the loss modulus of the matrix material is about $1\times10^5$ Pa.

8. The polishing pad of claim 6, wherein the matrix material comprises a loss factor, tan (δ), between about 0.05 and about 0.1.

9. The polishing pad of claim 6, wherein the polishing pad defines a pad volume, and the polymer particles comprise approximately 10 to 30% of the pad volume during polishing.

10. The polishing pad of claim 6, wherein the matrix material comprises at least one of siloxane polymer, crosslinked polydimethylsiloxane, and fluorinated polydimethylsiloxane.

11. The polishing pad of claim 6, wherein the matrix further comprises silica filler particles.

12. The polishing pad of claim 6, wherein the polymer particles comprise at least one of polyurethane, polyurea, polycarbonate, polyether, polyester, hydroxylated polyester, polysulfone, polystyrene, polyamide, polyacrylamide, polypropylene, polyethylene, polybutadiene, polyvinyl chloride, polymethyl methacrylate, polyvinyl alcohol, and nylon.

13. The polishing pad of claim 12, wherein the polymer particles have a mean particle diameter of approximately 50-70 μm.

14. A method of polishing a surface of a substrate, comprising:

providing a substrate; and contacting the substrate with a polishing pad, whereby the polishing pad and/or the substrate are moved relative to the other of the polishing pad and the substrate while in contact, the polishing pad comprising:

a matrix comprising a material having a storage modulus of about $1\times10^5$ Pa to about $1\times10^7$ Pa and a loss modulus of about $1\times10^4$ Pa to about $1\times10^6$ Pa, wherein the matrix material comprises a loss factor, tan (δ), between about 0.05 and about 0.3; and polymer particles embedded within the matrix during polishing, the polymer particles having a mean particle diameter of approximately 10 to 100 μm, wherein the polymer particles provide the loci of polishing.

15. The method of claim 14, wherein the substrate has a line to be polished, the line having a linewidth, and wherein the mean particle diameter of the polymer particles is at least approximately 2-20 times larger than the linewidth of the line to be polished.

* * * * *